United States Patent [19]

Hoffman

[11] 4,265,057

[45] May 5, 1981

[54] COLLET CHUCK ALIGNING ASSEMBLY FOR GEM FACETING MACHINES

[76] Inventor: Douglas L. Hoffman, Box 246-A, Clayton, Wash. 99110

[21] Appl. No.: 138,133

[22] Filed: Apr. 7, 1980

[51] Int. Cl.[3] ..... B24B 9/16

[52] U.S. Cl. ..... 51/229; 279/83

[58] Field of Search ..... 279/1 L, 83, 66; 51/229, 125

[56] References Cited

U.S. PATENT DOCUMENTS

| | | | |
|---|---|---|---|
| 523,893 | 7/1894 | Houck | 279/83 |
| 3,073,085 | 7/1963 | Ticino | 51/229 |
| 3,199,380 | 8/1965 | Threlkeld | 279/83 |
| 3,439,456 | 4/1969 | Bailey | 51/229 |

*Primary Examiner*—Harold D. Whitehead

*Attorney, Agent, or Firm*—Wells, St. John & Roberts

[57] ABSTRACT

Apparatus as described for centering a collet chuck relative to the longitudinal axis of a dop arm for a gem faceting machine. The apparatus includes a socket mounted to the dop arm and a plug slidably received within an open longitudinal bore formed within the socket. The plug mounts a collet chuck. Two longitudinally spaced sets of screws extend radially into the socket. The individual screws of the two sets can be turned against the plug to adjust the collet chuck into a secure precise coaxial relation with the dop arm axis.

10 Claims, 5 Drawing Figures

COLLET CHUCK ALIGNING ASSEMBLY FOR GEM FACETING MACHINES

BACKGROUND OF THE INVENTION

The present invention relates to a gem grinding apparatus having a dop arm for supporting a gem at the end of a dop mounted to a collet chuck. Various rotary tools such as drills and lathes have chucks for centering a cutting tool along the axis of a tool arbor. Similarly, a collet chuck of a dop arm is used to center the dop and gem coaxially with a dop arm axis. If the chuck and dop arm are not coaxial, however, the dop cannot effectively be centered on the dop arm axis.

It is most important that the axis of the dop be in alignment with the axis of the shaft supporting it in order that the ground surfaces on the attached gem will be symmetrical. Uneven and unsymmetrical facets result if the chuck and dop are not coaxial.

The standard dop arm mounts a chuck support. The chuck support, in turn, mounts the chuck. Misalignment of the chuck axis and dop axis occurs when the chuck support is not mounted very carefully to the dop arm or becomes jarred from coaxial alignment. In present practice, the dop arm and chuck support are fitted together, using a lathe. The interfitting parts are machined simultaneously to assure a coaxial fit between the dop arm and chuck. This takes time and requires sophisticated, expensive machinery. Also, the ultimate user of the faceting machine doesn't usually have the equipment or expertise for realignment.

It becomes desirable to mount the dop support on the dop arm so it can be adjusted easily and quickly in coaxial alignment with the dop arm axis, without need for sophisticated machinery, or expertise in mechanics.

DETAILED DESCRIPTION OF A PREFERRED EMBODIMENT

Figure 1:
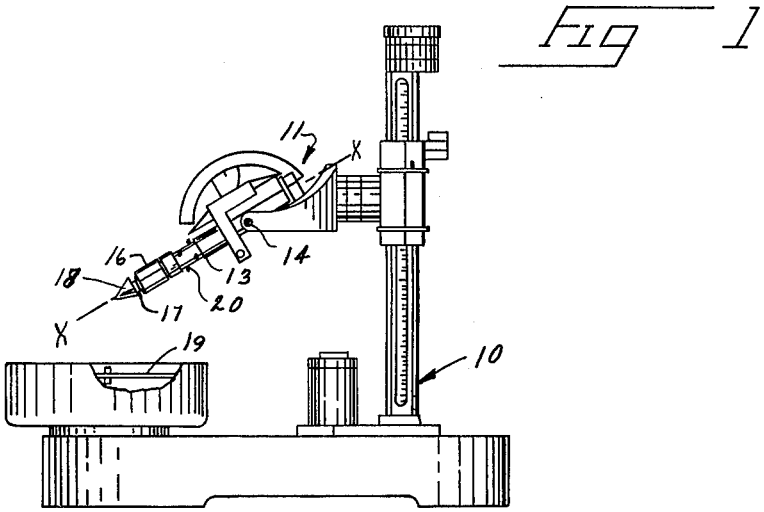
FIG. 1 is a diagrammatic overall view of a gem faceting machine incorporating features of the present invention.

The present invention is intended for use in conjunction with a gem faceting machine such as that generally shown at 10 in FIG. 1. The gem faceting machine typically includes an elongated dop arm assembly 11. The usual dop arm assembly is pivotably supported to hold a gem 18 at selected angular positions relative to a grinding surface or "lap" 19 so that precise facets may be formed on the surface of the gem.

Figure 2:
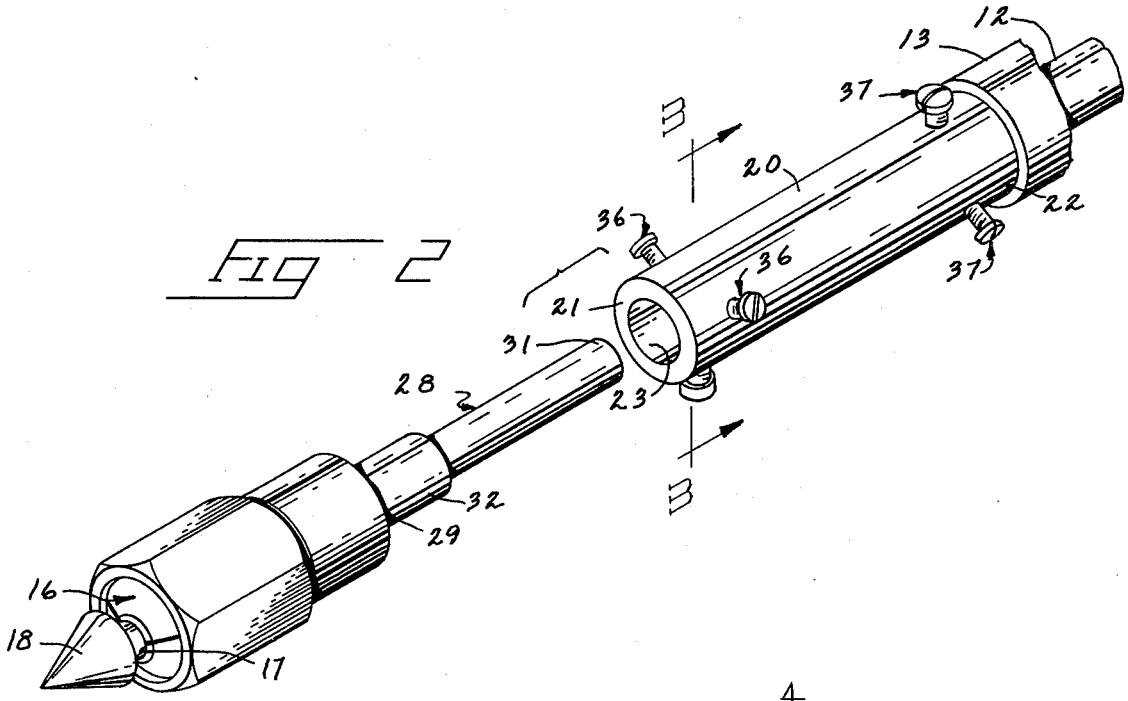
FIG. 2 is an exploded pictorial view of a dop arm and the present chuck mounting arrangement.

The dop arm assembly 11 typically includes a rotatable dop arm shaft 12 (FIG. 2) carried within an exterior sleeve 13 for rotation about a longitudinal dop arm axis X—X as indicated in FIG. 1. The dop arm assembly 11 is mounted to the faceting machine 10 at a pivot support 14. A forward arm end mounts a dop collet chuck assembly 16. A dop 17 is releasably received by the collet chuck assembly 16 to removably support a gem 18.

The dop 17 and chuck assembly 16 can be any of several conventional forms. However, it is preferred that a collet chuck be used for precision quick mounting and dismounting of the dop.

The present assembly includes a socket 20 that is adapted for rigid connection to the dop arm shaft 12 at the forward arm end. Alternatively, the socket 20 could be formed as an integral part of the shaft 12. The socket 20 extends from an open forward end 21 longitudinally to a rear end 22. An open bore 23 is formed within the socket 20. The bore 23 is formed about a longitudinal bore axis that is coincidental with the dop arm axis. The bore 23 extends from the open socket end 21 to a closed end 24 defined by the forward end of shaft 12 (FIG. 4).

Figure 4:
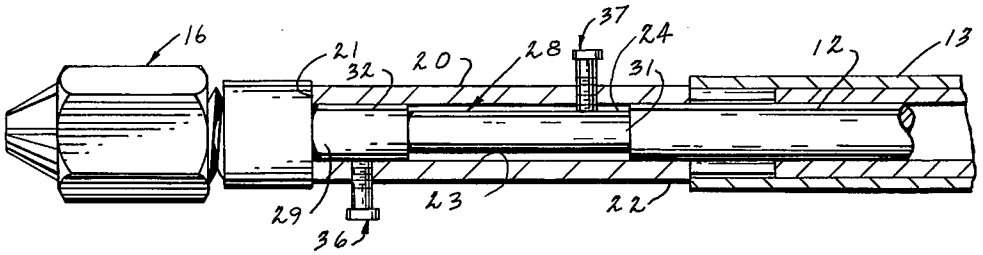
FIG. 4 is a longitudinal sectioned view taken substantially along line 4—4 in FIG. 3 with the present plug and collet chuck assembly in place.

The present assembly also includes a plug member 28 that is slidably received within the bore 23 as shown in FIG. 4 of the drawings. The plug 28 is elongated, having a forward end 29 adapted to secure a chuck 16. Preferably, the plug is substantially cylindrical and extends along a plug axis from the forward end 29 to a rearward plug end 31. The plug may also include an enlarged shoulder 32 adjacent the forward end 29.

FIG. 4 shows the interfitting relationship between the plug 28 and socket 20. The plug 28 is slidably received within the length of the bore 23 with the enlarged plug shoulder 32 situated adjacent the open forward socket end 21. The rearward plug end 32 is located at the closed bore end 24.

The plug is adjustably secured within the socket 20 by first and second sets of screws 36 and 37. The two sets of screws 36 and 37 each include at least three individual screws that are threadably engaged with the socket 20 and are radially oriented with respect to the axis of the bore (and dop arm axis).

It is conceivable that more than three screws be used for each set. However, any less than three screws in each set will not allow accurate positioning of the plug within the socket or hold the plug secure in position.

Figure 3:
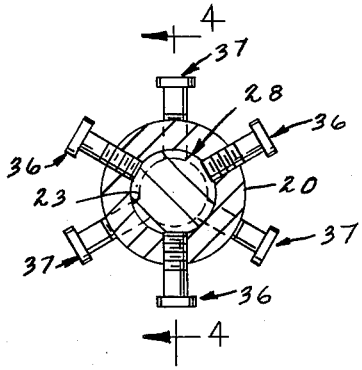
FIG. 3 is an enlarged sectional view taken along line 3–3 in FIG. 2.

The screws of each set 36 and 37 may be separated equiangularly about the bore axis of the socket. It is desirable to have the screws of one set offset to one side about the bore axis by 60° from the screws of the remaining set. In this manner, one screw of the first set will have a diametric opposite screw in the second set (as seen in FIG. 3).

The first set of three screws 36 is situated near the open forward end 21 of the socket. Each screw of the first set is threadably engaged with the socket so that its axis lies within a plane that is perpendicular to the coincidental bore and dop arm axes. Preferably, all three screws of the first set lie in a single plane perpendicular to the dop arm axis.

The second set of three screws 37 is spaced longitudinally from the first set 36 toward the closed rear end of the socket. The screws of the second set lie within a single plane that is perpendicular to the dop arm axis.

Figure 5:
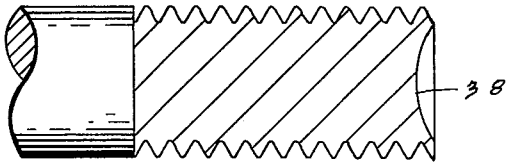
FIG. 5 is an enlarged fragmentary section view illustrating the cupped end of a screw used with the present invention.

The screw sets 36 and 37 are used to engage and adjustably secure plug 28 in place within bore 23. To this end, two of the screws (one of each set) include cupped ends 38 as shown graphically in FIG. 5.

The screws with cupped ends 38 are preferably diametrically opposed in relation to the central axis. They will thus press into the metal surfaces of plug 28 to hold it securely in position. The remaining screws of both sets have relatively flat end surfaces that will slide over the surface of the plug to allow adjustment.

The present chuck mounting arrangement facilitates both initial coaxial alignment of the chuck axis with the dop arm axis during assembly of the machine and subsequent alignment or readjustments by the user.

When the unit is being assembled, the plug 28 is inserted into the socket bore 23, bringing the forward plug end into abutment with the forward socket end 21. The enlarged shoulder 32, which is slightly undersized in comparison with the bore, is then situated adjacent the first set of screws 36 while the rearward plug end 31 is located adjacent the second set.

Preliminary centering is accomplished by the first set of screws which are turned inwardly until they are in relatively loose engagement with the shoulder 32. The screws of the second set are then turned into engagement with the plug end 31, bringing it into more precise alignment with the dop arm axis.

Actual experimentation has indicated that the chuck axis can be set in true coaxial alignment with the dop arm axis by adjustment of the second set of screws 37. This enables readjustment of the first set to center the chuck at the plane of the first set of screws into precise coaxial relationship with the dop arm axis.

The two sets of screws 36 and 37 not only act to secure the plug 28 and chuck 16 in place, but they center the plug at two points along its axis. The plug axis is therefore precisely located in relation to the dop arm axis. Futhermore, the six screws secure the plug at six angularly spaced locations simulating a "hex" mount (FIG. 3) that will not readily come out of adjustment.

A chuck can be knocked out of alignment with the dop arm if it is accidently bumped or dropped against a hard surface. Realignment can be accomplished with the present invention without removing the dop arm or chuck from the faceting machine. The operator simply repeats the above described procedure while turning the dop arm shaft and chuck in relation to a conventional dial indicator (not shown) or other off-center sensing apparatus for checking shaft alignment.

Accuracy of adjustment for the present arrangement is a factor of the distance between the two sets of screws 36 and 37. Ideally, the greater the distance between the two sets of screws, the more accurately the chuck and dop arm can be aligned. This is true because the first set of screws 36 initially operate as a fulcrum while the second set 37 adjustably position the chuck and plug about the point set by the fulcrum. Precise adjustment of the chuck axis about the fulcrum point can be made with greatest speed and accuracy at points spaced as far as possible from the fulcrum. Final adjustment at the fulcrum serves to even more precisely align the dop arm axis with that of the chuck and dop.

The above description and attached drawings are given by way of example to set forth a preferred form of my invention. The scope of my invention, however, is more precisely set forth by the following claims.

What I claim is:

1. Apparatus for coaxially aligning a chuck on the dop arm of a gem faceting machine, comprising:

an elongated plug having a forward plug end adapted to mount the collet chuck along a central chuck axis and a longitudinally spaced rearward plug end;

a socket having an open longitudinal bore leading rearwardly along a bore axis from an open socket end to a closed socket end, said socket being adapted to mount to a dop arm along a dop arm axis;

said socket slidably receiving the elongated plug along the length of said bore;

a first set of three screws threadably mounted through the socket, said screws being equiangularly spaced about the bore axis and being radially extendable into the longitudinal bore;

said first set of three screws being situated across a single plane perpendicular to the bore axis and situated adjacent the open socket end;

a second set of three screws threadably mounted through the socket, said screws being equiangularly spaced about the bore axis and being radially extendable into the longitudinal bore;

said second set of three screws being situated across a single plane perpendicular to the bore axis and is situated adjacent the closed socket end.

2. The apparatus as defined by claim 1 wherein the screws of the first set are offset angularly about the bore axis from the screws of the second set by 60°.

3. The apparatus as defined by claim 1 wherein the elongated plug includes an enlarged shoulder adjacent its forward end to be received within the socket bore and to be engaged by the first set of three screws.

4. The apparatus as defined by claim 1 wherein the axes of the first set of screws are angularly offset to one side about the bore axis of the socket from the axes of the second set of screws.

5. A collet chuck support apparatus for a gem faceting machine, comprising:

an elongated dop arm formed along a dop arm axis, having a forward projecting end and a rearward end, said rearward end being adapted for mounting to a gem faceting machine;

a socket at the forward end of the dop arm leading forwardly therefrom to an open socket end;

an axial bore formed longitudinally within the socket extending along the dop arm axis rearwardly to a closed end from the open socket end;

a first set of three screws threadably mounted through the socket and radially extendable into the bore;

said first set of screws being equiangularly spaced about the dop arm axis adjacent to the open socket end;

a second set of three screws threadably mounted through the socket and radially extendable into the bore;

said second set of screws being equiangularly spaced about the dop arm axis adjacent the closed bore end;

an elongated plug member receivable within the socket bore to engaged by the first and second pairs of screws and secured thereby to the socket and dop arm;

a collet chuck having a longitudinal chuck axis mounted to the plug member;

wherein the first and second screw sets are adjustable against the plug member to secure the plug member to the socket with the chuck axis and dop arm axis in coaxial alignment.

6. The apparatus as defined by claim 5 wherein the screws of the first set are angularly offset to one side about the bore axis of the socket from the screws of the second set.

7. The apparatus as defined by claim 5 wherein the three screws of the first set offset angularly from the screws of the second set about the bore axis by 60°.

8. The apparatus as defined by claim 5 wherein the elongated plug member includes an enlarged shoulder adjacent its forward end to be received within the socket bore and to be engaged by the first set of three screws.

9. The apparatus as defined by claim 5 wherein one screw of each set includes a cup point for engaging and locking the plug member to the socket.

10. The apparatus as defined by claim 9 wherein:

the remaining screws of both sets include flat ends for slidably engaging the plug; and wherein the cup point screws are set 180° apart from one another about the dop arm axis.

* * * * *